United States Patent [19]

Sullivan et al.

[11] Patent Number: 4,858,245

[45] Date of Patent: Aug. 22, 1989

[54] ARMORED GLOVE FINGERS

[76] Inventors: Thomas M. Sullivan, 3953 Oregon St., San Diego, Calif. 92104; Edward A. Coppage, Jr., 3031 Borge St., Unit 109, Oakton, Va. 22124

[21] Appl. No.: 195,863

[22] Filed: May 19, 1988

[51] Int. Cl.[4] ..... A41D 19/00; A41D 19/02

[52] U.S. Cl. ..... 2/21; 2/163; 2/169

[58] Field of Search ..... 2/21, 163, 164, 165, 2/167, 169

[56] References Cited

U.S. PATENT DOCUMENTS

| | | | |
|---|---|---|---|
| 556,581 | 3/1896 | Loewenstine | 2/163 |
| 2,039,505 | 5/1936 | Vollmer | 2/21 |
| 2,646,796 | 7/1953 | Scholl | 450/93 X |
| 2,847,005 | 8/1958 | Bourne | 2/21 X |
| 3,184,756 | 5/1965 | DeLuca | 2/21 X |
| 3,263,681 | 8/1966 | Nechtow et al. | 2/21 X |
| 4,214,321 | 7/1980 | Nuwayser | 2/167 |
| 4,526,828 | 7/1985 | Fogt et al. | 2/7 X |

*Primary Examiner*—Werner H. Schroeder
*Assistant Examiner*—Sara M. Current
*Attorney, Agent, or Firm*—Sherman and Shalloway

[57] ABSTRACT

An armored glove finger comprises a rib knit tubular member having an open end and an end closed with a seam. The tubular member is adapted to receive a human finger therein with the tip of the finger abutting the closed end and the seam disposed over the fingernail of the finger. The knit tube comprises a fiber of 100 to 650 denier made from a yarn having a tensile strength in excess of 120,000 psi. The armored glove finger resists inadvertent cuts and punctures and may be used in conjunction with conventional gloves or may be incorporated into a glove structure.

22 Claims, 2 Drawing Sheets

Fig. 1
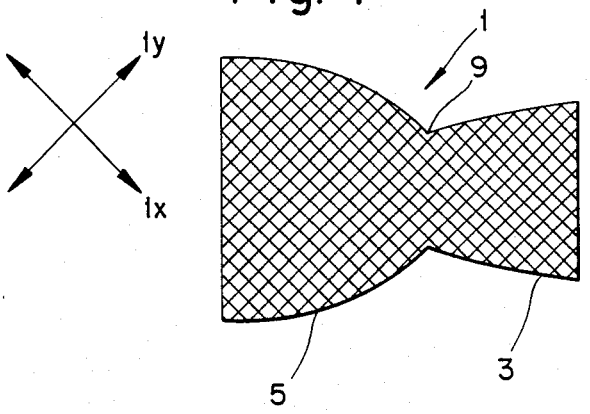
Fig. 2
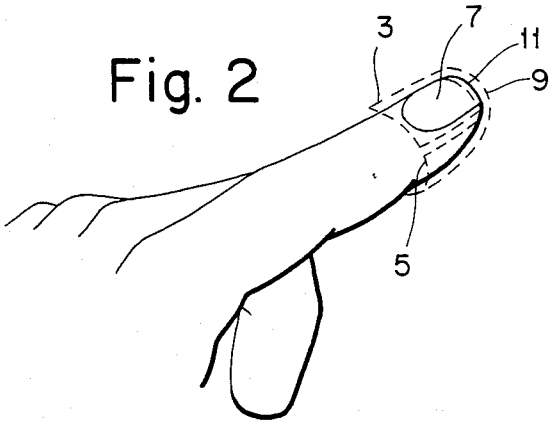
Fig. 3
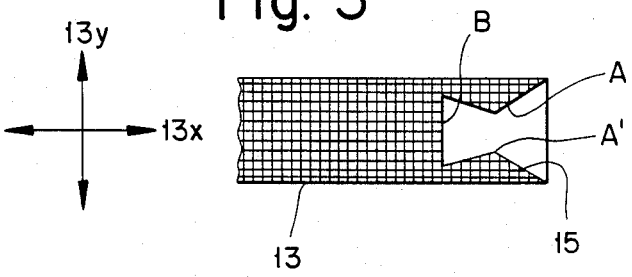
Fig. 4
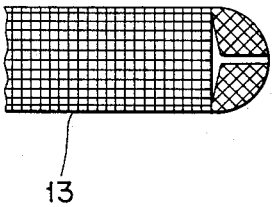
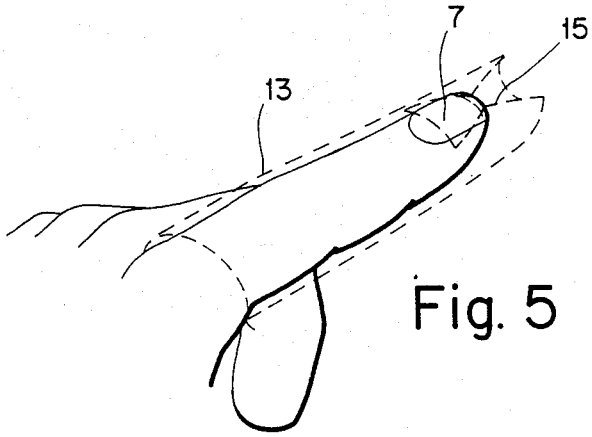
Fig. 5

ARMORED GLOVE FINGERS

BACKGROUND OF THE INVENTION

1. Field of the Invention

The present invention is directed to an armored glove finger and gloves therefrom so as to resist inadvertent punctures or cuts. More particularly, the armored glove fingers are utilized in and/or with latex gloves to prevent infection of the wearer.

2. Description of the Prior Art

Numerous attempts have been made to provide protection against inadvertent cuts and puncture wounds in the handling and/or utilization of sharp implements, for instance:

U.S. Pat. No. 1,916,921, to Dougan, discloses a thumb protector comprising a rubber finger cot having a thickened portion embedded with lead particles.

U.S. Pat. No. 2,039,505, to Vollmer, discloses a finger protector comprising a rubber cot having a metal mesh embedded in the rubber.

U.S. Pat. No. 4,214,321, to Nuwayser, discloses a glove for use with organic solvents that is made of a flexible multilaminated sheet comprising an outer abrasion-resistant polymer layer, a pin-hole-free aluminum foil layer and an inner heat-sealable thermoplastic polymer material.

U.S. Pat. No. 4,526,828, to Fogt et al., discloses a protective material comprising a base layer composed of textile material, an intermediate layer composed of a cut-resistant material having intermeshing strands defining pores therebetween and an outer layer composed of solid, elastomeric material which retards penetration by liquid. The elastomeric material covers and is bonded to the base layer which prevents passage entirely therethrough by liquid elastomeric material but permits partial penetration. The solid elastomeric material extends through the pores of the intermediate layer and encapsulates the strands thereof.

U.S. Pat. No. 2,646,796, to Scholl, discloses a self-bonding tubular bandage of knitted fabric.

U.S. Pat. No. 2,847,005, to Bourne, discloses a surgical dressing comprising a fingertip pad over which a flexible member is wrapped with the seam passing over the top and side of the finger.

U.S. Pat. No. 3,263,681, to Nechtow et al., discloses a finger cot comprising layers of rubber and fabric that provide increased traction for a surgeon's finger.

Nonetheless, there is still a need for a glove which provides both protection from inadvertent cuts and punctures and sufficient "feel" to allow dependence on the sense of touch.

SUMMARY OF THE INVENTION

It is an object of the invention to provide an armored glove finger which can be utilized in conjunction with a conventional surgeon's latex rubber glove or which can be incorporated into a glove so as to provide protection from inadvertent cuts or punctures while allowing the surgeon sufficient residual "feel" so as to allow reliance on the sense of touch while probing wounds, cavities, etc.

It is a further object of the invention to provide an armored glove finger which is biocompatible, i.e. does not contain any materials which are deleterious to living tissue, so as to be particularly suitable for medical use.

It is a still further object of the present invention to provide an armored glove finger which is effective in all instances where protection from inadvertent cuts and punctures is desired.

These and other objects of the invention, as will become apparent hereinafter, have been attained by the provision of a biocompatible armored glove finger comprising a tubular, seamless fabric element having an open end and an end closed with a seam, said tubular, seamless fabric element being adapted to receive a human finger therein through said open end with the tip of the finger substantially abutting the closed end and the seam disposed over the fingernail of the finger, the tubular, seamless fabric element comprising a first fiber of about 100 to about 650 denier, the first fiber comprising at least one yarn having a tensile strength in excess of about 120,000 psi.

In a further embodiment, the present invention provides an armored glove finger comprising a tubular, seamless fabric element having an open end and an end closed with a seam, the tubular, seamless fabric element being adapted to receive a human finger therein through said open end with the tip of the finger substantially abutting the closed end and the seam disposed over the fingernail of the finger, the tubular, seamless fabric element comprising a first fiber of about 100 to about 650 denier, the first fiber comprising at least one yarn having a tensile strength in excess of about 120,000 psi; and a fabric reinforcement patch disposed proximate the closed end of the tubular, seamless fabric element on the interior of the tubular, seamless fabric element and fixed thereto so as to substantially cover at least the fingertip of the finger received within said tubular, seamless fabric element, the fabric reinforcement patch comprising a yarn having a tensile strength in excess of about 120,000 psi and of 650 denier; said tubular, seamless fabric element having said first fiber disposed in interlocked loops in two substantially perpendicular directions; the fabric reinforcement patch having the yarn of 650 denier disposed in two interwoven substantially perpendicular directions; the two substantially perpendicular directions of the first fiber being disposed at an angle to the two substantially perpendicular directions of said interwoven patch yarn of 650 denier.

BRIEF DESCRIPTION OF THE DRAWING FIGURES

FIG. 1 is a plan view of a fabric reinforcing patch.

FIG. 2 illustrates placement of the fabric reinforcing patch over a finger.

FIG. 3 is a plan view of a rib knit fabric tube ready for assembly.

FIG. 4 is a plan view of the "assembled" fabric tube.

FIG. 5 illustrates placement of the fabric tube over a finger.

DETAILED DESCRIPTION OF THE INVENTION

Figure 6:
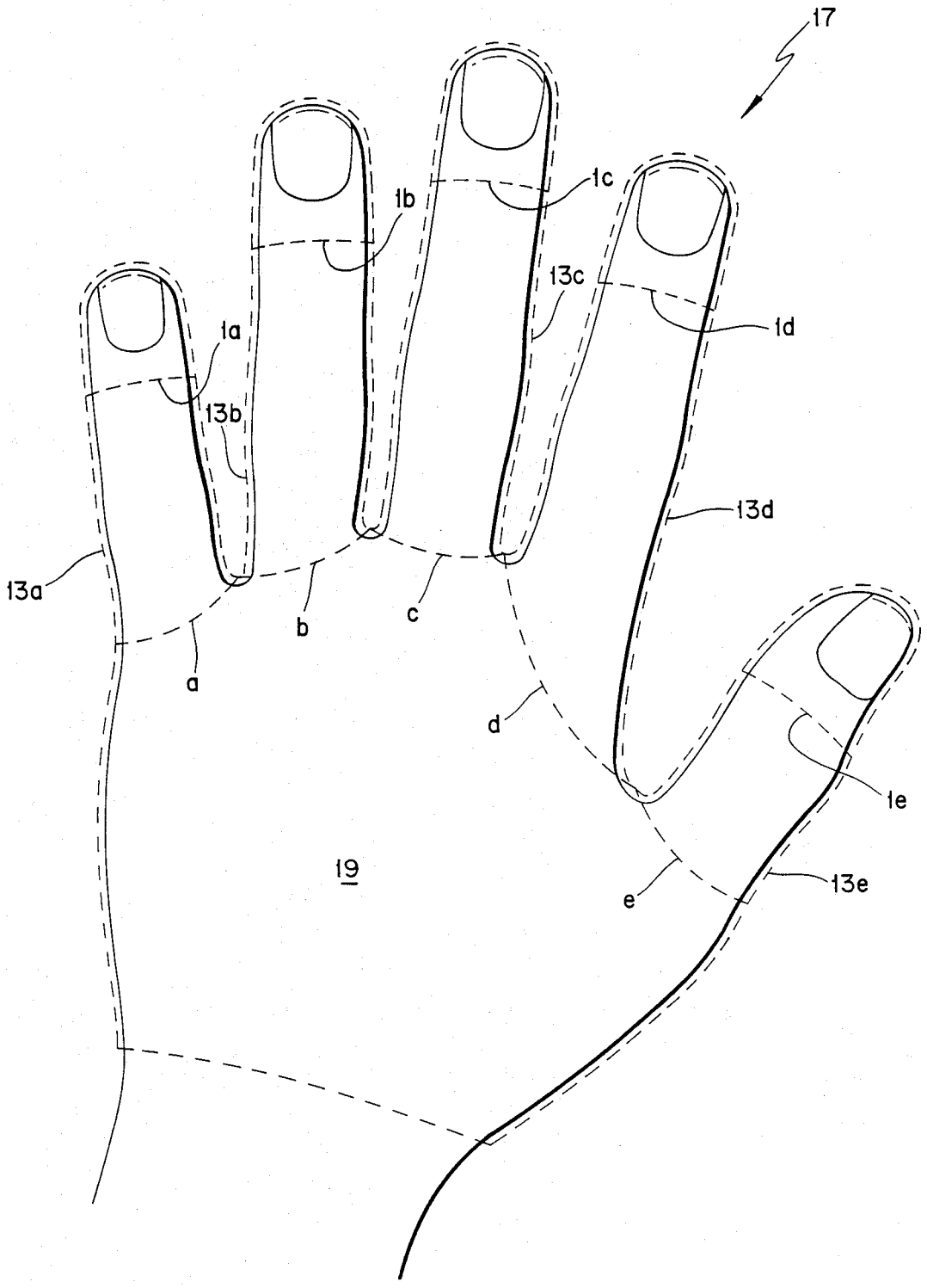
FIG. 6 illustrates placement of a glove structure incorporating the present armored fingers over a hand.

In FIG. 1, a fabric reinforcement patch, generally indicated at 1, comprises a smaller end 3 and a larger end 5. The smaller end 3, as best seen in FIG. 2, substantially fits over the fingernail 7 of a wearer with the narrow portion 9 of the patch 1 over the outer edge 11 of the fingernail 7. Drawing the large end 5 of the fabric reinforcement patch over and under the tip of the finger and back to the first joint of the finger causes the reinforcement patch to close upon itself along the sides at the top of the finger.

The fabric reinforcement patch 1 may be used in conjunction with a tubular, seamless fabric element 13, as shown in FIGS. 3–5, or a plurality of such fabric reinforcement patches may be layered and used with the tubular, seamless fabric element 13, or the tubular, seamless fabric element may be used alone.

Turning to FIGS. 3–5, the tubular seamless fabric element 13 is preferably formed of a rib knit fabric tube due to the ability of a rib knit to stretch and conform to the shape of the finger. In particular, the tubular, seamless fabric element 13 has an "hour-glass" pattern 15 cut from one side of the tubular element in what will be the "fingernail region" of the finger, as best seen in FIG. 5. Thus, when point "A" is brought back to backline "B" and then point "A'" is brought to the backline "B", the end of the tubular element 13 closes snugly about the fingertip with the seams above the fingernail 7, as shown in FIG. 4.

As shown in FIG. 6, a plurality of tubular elements 13*a*, 13*b*, 13*c*, 13*d*, 13*e* and a plurality of reinforcement patches 1*a*, 1*b*, 1*c*, 1*d*, 1*e* may be assembled to form a glove-like structure, generally indicated at 17, in conjunction with a palm/back hand piece 19 to which each of the tubular elements is attached along a respective seam a, b, c, d, e.

All seams may be assembled and connected in any conventional manner, however, adhesive bonding, especially ultrasonically stimulated bonding, has been found to be particularly convenient and effective.

As may best be seen in FIG. 3, the fiber which forms the tubular, seamless element 13 runs substantially in a first direction 13*x* and a second direction 13*y*. Likewise, as may best be seen in FIG. 1, the fiber which forms the fiber reinforcement patch 1 runs substantially in a first direction 1*x* and a second direction 1*y*. Directions 13*x* and 13*y* are substantially perpendicular to one another, and directions 1*x* and 1*y* are substantially perpendicular to one another. When both a patch and a tubular element are utilized the directions 13*x* and 13*y* are arranged at an angle to the directions 1*x* and 1*y*. When more than one patch is utilized, each succeeding patch is angled relative to the preceding patch so that there is no clear path through the interstices of the fiber materials, i.e. all fiber directions are at an angle to one another.

The present fabric elements, i.e. the fiber reinforcement patch and the tubular, seamless fabric element may be made of the same or different fibers. The fibers are in turn prepared from yarns of high tensile strength, i.e. yarns having a tensile strength in excess of about 120,000 psi. Suitable yarns include nylon 6 (a polycondensate of caprolactam), polyvinyl alcohol, Dacron® (polyethylene terephthalate, DuPont), Kevlar® (polyaramid, DuPont) and ultra-high-molecular-weight polyethylene. While Kevlar® provides fibers of great tensile strength (in excess of 450,000 psi), carcinogenic solvents are utilized in its preparation and it thus cannot be considered to be a biocompatible material. (Throughout the present text, "biocompatible" is used to designate materials which are nondeleterious to living tissue and are approved by the FDA as such.) Thus, for medical usage, e.g., with or in surgical gloves, it is preferred to utilize ultra-high-molecular-weight polyethylene yarns, which are biocompatible, have tensile strengths up to about 375,000 psi, have a tensile modulus (ASTM D885) up to about 16,500,000 psi, are inert, are lubricious (i.e. tend to deflect penetrating objects thus absorbing their force of penetration) and are sterilizable by all currently known and utilized techniques without loss of properties.

Ultra-high-molecular-weight polyethylenes are well-known and are commercially available with molecular weights in excess of 400,000, generally greater than 1,000,000 and, typically, of 3,000,000 to 6,000,000 or higher. Yarns made from such ultra-high-molecular weight polyethylenes are available from such companies as Allied Signal, with the Spectra® brand of Allied Signal presently preferred.

The fabric reinforcement patch is typically formed of a close-woven yarn having a denier (weight in grams of 9,000 meters of yarn) of about 375 or higher. Heavier weights of yarn can be utilized, however, increasing weight results in loss of "feel". Accordingly, an upper limit of about 650 denier has been found to be acceptable for minimizing loss of "feel" while affording maximal protection against inadvertent cuts and penetrations, especially when utilized in conjunction with the tubular, seamless fabric element. When multiple, layered patches are utilized it is preferred that the total of the deniers of the fiber utilized in the patches fall within the above limits. For example, a single patch formed of a 375 denier yarn could be replaced by three patches formed from 175 denier yarn, 100 denier yarn and 100 denier yarn respectively. While any number of patches may be layered, more than about three start to produce a "pillowing" effect whereby feel is lost. Typically, the fiber reinforcement patches will be plain woven or possibly basket woven, although other close-woven weaves such as rib weave (utilizing different weight yarns) and twill may also be utilized.

A plain woven fabric is preferred, and the use of a 5 plain woven patch of 650 denier yarn woven on 38×38 needles has been found to be highly resistant to penetration and/or puncture. For a given denier yarn, lower needling patterns, e.g., 30×30, will give a more loosely woven material. Likewise, for a given needling pattern, e.g., 38×38, lighter yarns (lower denier) will also give a more loosely woven material. Such variations are within the scope of the present invention, however, when using more loosely woven materials, it is preferred to utilize multiple-layer patches, angled in the aforementioned manner. Nonetheless, it is most preferable if both the needling pattern and the yarn (denier) are selected so as to give penetration and/or puncture resistance substantially equivalent to that of the 650 denier yarn woven on 38×38 needles, i.e. for lighter yarns use higher needling patterns and vice versa. By this technique, puncture-resistance is substantially retained without substantial loss of "feel".

The tubular, seamless fabric element is typically formed of a knit yarn having a denier of about 100 up to about 650. Preferably, the knit is a rib knit so as to confer a degree of stretchability on the tubular element so as to allow ready conformation to a finger inserted therein. Typically the rib knit will be made with 35×35 to 75×75 needles, preferably utilizing 50×50 needles. The knit fiber may comprise a single yarn, e.g. 185 denier, or two or more yarns, e.g. two yarns of 100 denier, to give substantially the desired denier value, however, each yarn should have a denier of at least 100.

Testing has indicated that a rib knit fabric tube made with 50×50 needles and two 100 denier yarns (or one 185 denier yarn) over a 650 denier (38×38 needles) woven fabric reinforcement patch allows ready conformation to individual finger contours, cannot be accidentally cut with a sharp scalpel, and can only be punctured with great difficulty (the fibers in the 650 denier woven patch being predominantly disposed at an acute angle to fibers in the rib knit fabric).

As previously noted, the armored glove finger has no seams along the side of the finger or on the tip of the finger so as to not interfere with the "feel" of the wearer. Seams are formed over the fingernail portion of the finger. Preferably, the seams are ultrasonically "stitched" utilizing a matrix material to aid in the compositing, e.g., a polymethylmethacrylate or a low molecular weight polyethylene, or any other polymer (preferably biocompatible) susceptible to ultrasonic stimulated compositing.

The armored glove finger may be assembled by folding the reinforcement patch over a sculpted finger, as previously described. The rib knit fabric tube is then slipped over the patch with the "hour glass" pattern over the fingernail and the points "A" and "A'", as previously described, are then stretched to the backline "B". The seams are then "stitched" with an ultrasonic gun. Preferably, in the case of the use of ultra-high-molecular-weight polyethylene, a few drops of a polymethylmethacrylate adhesive are placed on the reinforcement patch over the fingernail, prior to closure of the end of the rib knit fabric tube. The adhesive both aids in closure of the tube and interconnection of the patch and the tube.

The armored glove fingers can be worn as cots or can be fabricated into complete gloves. When used as cots, and used in surgery, one pair of latex surgical gloves may be worn under the armored glove fingers and one pair of latex surgical gloves may be worn over the armored glove fingers (the inner latex glove assuring a sterile operating environment at all times). When fabricated as a glove structure, the glove structure can be impregnated with latex rubber to form surgeon's gloves or with other impregnants such as butyl rubber to form gloves for chemical worker to protect them from contact with pesticides, chemical warfare agents, etc.

What is claimed is:

1. A biocompatible armored glove finger comprising a tubular, seamless fabric element having an open end and an end closed with a seam, said tubular, seamless fabric element being adapted to receive a human finger therein through said open end with the tip of said finger substantially abutting said closed end and said seam disposed over the fingernail of said finger, said tubular, seamless fabric element comprising a first fiber of about 100 to about 650 denier, said first fiber comprising at least one yarn having a tensile strength in excess of about 120,000 psi.

2. The biocompatible armored glove finger according to claim 1, wherein said first fiber comprises a yarn of 185 denier.

3. The biocompatible armored glove finger according to claim 1, wherein said first fiber comprises two yarns, each of 100 denier.

4. The biocompatible armored glove finger according to claim 1, wherein said tubular, seamless fabric element comprises a rib knit fabric tube.

5. The biocompatible armored glove finger according to claim 1, wherein said at least one yarn has a modulus in excess of about 4,500,000 psi.

6. The biocompatible armored glove finger according to claim 5, wherein said at least one yarn comprises an ultra-high- molecular-weight polyethylene yarn.

7. The biocompatible armored glove finger according to claim 1, further comprising at least one fabric reinforcement patch disposed proximate said closed end of said tubular, seamless fabric element and fixed thereto so as to substantially cover at least the fingertip of a finger received within said tubular, seamless fabric element, said at least one fabric reinforcement patch comprising a total second fiber weight of at least 375 denier, said second fiber comprising at least one yarn having a tensile strength in excess of about 120,000 psi.

8. The biocompatible armored glove finger according to claim 7, wherein said at least one fiber reinforcement patch comprises a single woven patch.

9. The biocompatible armored glove finger according to claim 8, wherein said second fiber comprises a single yarn of 650 denier.

10. The biocompatible armored glove finger according to claim 7, wherein said tubular, seamless fabric element has said first fiber disposed in interlocked loops in two substantially perpendicular directions; and wherein said at least one fabric reinforcement patch has said second fiber disposed in two interwoven substantially perpendicular directions; said two substantially perpendicular directions of said first fiber being disposed at an angle to said two substantially perpendicular directions of said second fiber.

11. The biocompatible armored glove finger according to claim 7, wherein said at least one yarn of said second fiber has a modulus in excess of about 4,500,000 psi.

12. The biocompatible armored glove finger according to claim 11, wherein said at least one yarn of said second fiber comprises an ultra-high-molecular-weight polyethylene yarn.

13. The biocompatible armored glove finger according to claim 7, wherein said at least one fabric reinforcement patch comprises a first end and a second end, said first end being smaller than said second end; said first end being adapted to substantially cover the fingernail of a finger; said second end being adapted to fold over the fingertip and back to at least the first joint of the finger, closing over the sides of the fingernail forming seams substantially over the fingernail.

14. An armored glove finger comprising a tubular, seamless fabric element having an open end and an end closed with a seam, said tubular, seamless fabric element being adapted to receive a human finger therein through said open end with the tip of said finger substantially abutting said closed end and said seam disposed over the fingernail of said finger, said tubular, seamless fabric element comprising a first fiber of about 100 to about 650 denier, said first fiber comprising at least one yarn having a tensile strength in excess of about 120,000 psi; and a fabric reinforcement patch disposed proximate said closed end of said tubular, seamless fabric element on the interior of said tubular, seamless fabric element and fixed thereto so as to substantially cover at least the fingertip of a finger received within said tubular, seamless fabric element, said fabric reinforcement patch comprising a yarn having a tensile strength in excess of about 120,000 psi and of 650 denier; said tubular, seamless fabric element having said first fiber disposed in interlocked loops in two substantially perpendicular directions; said fabric reinforcement patch having said yarn of 650 denier being disposed in two interwoven substantially perpendicular directions; said two substantially perpendicular directions of said first fiber being disposed at an angle to said two substantially perpendicular directions said yarn of 650 denier.

15. The armored glove finger according to claim 14, wherein said angle is 45°.

16. The armored glove finger according to claim 14, wherein said first fiber is a single yarn of 185 denier.

17. The armored glove finger according to claim 14, wherein said first fiber comprises two yarns, each of 100 denier.

18. The armored glove finger according to claim 14, wherein said tubular, seamless fabric element is rib knit.

19. The armored glove finger according to claim 14, wherein said at least one yarn has a modulus in excess of about 4,500,000 psi.

20. The armored glove finger according to claim 19, wherein at least one yarn is an ultra-high-molecular-weight polyethylene yarn.

21. The armored glove finger according to claim 14, wherein said yarn of 650 denier has a modulus in excess of about 4,500,000 psi.

22. The armored glove finger according to claim 21, wherein said yarn of 650 denier is an ultra-high-molecular-weight polyethylene yarn.

* * * * *